United States Patent [19]

Klayman

[11] Patent Number: 4,819,269

[45] Date of Patent: Apr. 4, 1989

[54] EXTENDED IMAGING SPLIT MODE LOUDSPEAKER SYSTEM

[75] Inventor: Arnold I. Klayman, Huntington Beach, Calif.

[73] Assignee: Hughes Aircraft Company, Los Angeles, Calif.

[21] Appl. No.: 76,412

[22] Filed: Jul. 21, 1987

[51] Int. Cl.[4] ..... H04R 5/02

[52] U.S. Cl. ..... 381/24; 381/86

[58] Field of Search ..... 381/1, 86, 17, 18, 27, 381/24

[56] References Cited

U.S. PATENT DOCUMENTS

| | | | |
|---|---|---|---|
| 3,697,692 | 10/1972 | Hafler | 179/1 G |
| 3,745,254 | 7/1973 | Ohta et al. | 179/1 GQ |
| 3,757,047 | 9/1973 | Ito et al. | 179/1 GQ |
| 3,761,631 | 9/1973 | Ito et al. | 179/1 GQ |
| 3,885,101 | 5/1975 | Ito et al. | 179/1 GQ |
| 4,182,931 | 1/1980 | Kenner | 179/1 E |
| 4,218,583 | 8/1980 | Poulo | 179/1 E |
| 4,332,979 | 6/1982 | Fischer | 179/1 GQ |
| 4,348,549 | 9/1982 | Berlant | 179/1 E |
| 4,497,064 | 1/1985 | Polk | 381/24 |
| 4,569,074 | 2/1986 | Polk | 381/24 |
| 4,580,654 | 4/1986 | Hale | 181/146 |
| 4,589,129 | 5/1986 | Blackmer et al. | 381/21 |
| 4,593,404 | 6/1986 | Bolin | 381/82 |
| 4,594,729 | 6/1986 | Weingartner | 381/24 |
| 4,638,505 | 1/1987 | Polk et al. | 381/24 |
| 4,691,362 | 9/1987 | Eberbach | 381/24 |
| 4,703,502 | 10/1987 | Kasai et al. | 381/86 |

OTHER PUBLICATIONS

Audio Cyclopedia, 1979, p. 1092.

Paper: "Multichannel Stereo Matrix Systems: An Overview", by John M. Eargle, Journal of the Audio Engineering Society, pp. 552–558, Jul./Aug. 1971.

*Primary Examiner*—Forester W. Isen

*Attorney, Agent, or Firm*—Joseph E. Szabo; Anthony W. Karambelas

[57] ABSTRACT

Direct field sound, represented by the sum of left and right stereo input signals, is projected in a narrow dispersion pattern from a front radiating speaker 28,32 and reverberant field sounds, represented by difference between left and right stereo input signals, is projected from speakers 26,30 having a wide dispersion pattern. Direct field and reverberant field sounds are acoustically combined in space to create an improved representation of stereo sound.

40 Claims, 5 Drawing Sheets

EXTENDED IMAGING SPLIT MODE LOUDSPEAKER SYSTEM

BACKGROUND OF THE INVENTION

1. Field of the Invention

The present invention relates to stereophonic speaker systems, and more particularly concerns an improved combination of speaker characteristics with speaker driving component signals to provide improved stereophonic sound.

2. Description of Related Art

In reproduction of stereophonic sound, electrical signals generally representing left and right channel stereo input sounds are combined or processed and fed to left and right channel speaker systems or to various combinations of speaker systems, with the goal of reproducing for the listener a sound that most realistically depicts sound heard during an actual, live performance. In attempts to achieve this goal, electrical stereophonic signals have been combined and processed in various manners. Major efforts have been made in careful design and manufacture of recording, mixing and production equipment so that the electrical end product will reflect as closely as possible precisely what performing artists, engineers, mixers or producers wish to convey to the listener. Signals have been fed to speakers positioned in various locations and in various groups, and speakers have been energized by various combinations of stereo signals in further attempts to improve realism of the sound. Artificial time delays, reverberation techniques and deliberate reflections from various walls have been employed, often at the expense of introduction of extraneous information of a type not originally present, thus actually changing the effect of the original performance. Yet, all the prior effort has not resulted in attainment of the goal of realistic reproduction of the sound of a live performance.

The spatial acoustical field produced in a live performance varies in accordance with acoustics of the performance area, and, importantly, in accordance with the type or nature of the performer or performers. For example, a solo vocalist or instrumentalist positioned at center stage will primarily provide sound known as direct field sound, that is radiated directly to the listeners in the audience. However, where performers are spread across a wide stage, for example, as in a performance of a large choral group or a large symphony orchestra, significant portions of sound received by the audience are reflected from various parts of the theater so that the audience receives a mixture of direct field sound, radiated directly from the performers, and sound known as reverberant field sound, that is reflected from the walls of the theater. In the case of some sounds, such as the immense organ chords of a Saint-Saens organ symphony, the music resounds and reverberates from surfaces in all areas of the theater.

Various combinations of speaker systems, including those that reflect a majority of sound from a wall behind the speaker, do not adequately reproduce all desired sounds with sufficient realism. Moreover, speaker systems arranged for one particular location or environment are not readily scaled up or down to operate in other environments so that, for example, a speaker system designed for a living room environment is not properly operable in an automobile, theater, or even outdoors.

Accordingly, it is an object of the present invention to provide a loudspeaker system that avoids or minimizes problems of prior systems and produces a spatial acoustical field which is more realistically representative of the live performance, and, moreover, is flexible in its application to different environments.

SUMMARY OF THE INVENTION

In carrying out principles of the present invention, in accordance with a preferred embodiment thereof, direct field sounds are radiated from a front radiating speaker system and reverberant field sounds are projected from a speaker system having a wider dispersion pattern. According to a specific feature of the invention, a front radiating speaker system having a narrow dispersion pattern is energized from a signal representing the sum of left and right stereo input signals and a pair of companion speaker systems, having wide dispersion patterns, is energized from signals representing difference between left and right stereo signals. Direct field sound representing a stereo sum signal, and radiated in a narrow dispersion pattern, is combined acoustically with reverberant field sound representing difference signals, and radiated in a wide dispersion pattern.

DESCRIPTION OF A PREFERRED EMBODIMENT

Figure 1:
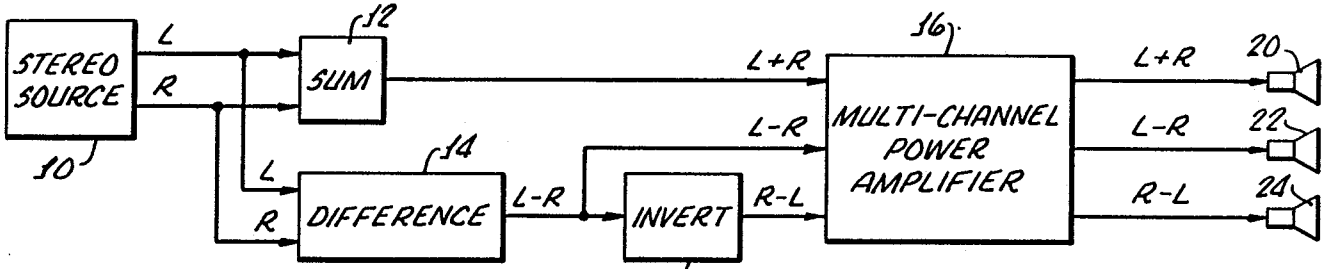
FIG. 1 is a block diagram illustrating a loudspeaker system embodying principles of the present invention.

Principles of the present invention are based upon a combination of control of (a) radiation of direct and reverberant field sounds and (b) the electronic processing of stereophonic left and right signals.

With respect to radiation of sound, the present invention takes advantage of the fact that a front radiating speaker system is effective for reproduction of direct field sound, but is relatively ineffective for reproduction of reflected or reverberant field sound. Further, an omnidirectional or wide dispersion speaker system is just the opposite, effective in reproduction of reverberant field sound, but ineffective for reproduction of direct field sound, which appears to be strangely disembodied by an omnidirectional speaker system.

With respect to electronic processing of the stereophonic left and right signals L and R, it is known that these signals may be broken down into their sum (L+R) and difference (L−R) or (R−L) components. It is also known that such components may be electrically remixed in various manners so as to reassemble the original stereophonic signals. For example, $(L+R)+(L-R)=2\ L$, and $(L+R)+(R-L)=2\ R$. Further, in my prior copending application for Stereo Enhancement System, filed Mar. 27, 1986, Ser. No. 844,929, I describe various methods for specifically processing sum and difference signals (according to various frequency bands) and producing stereo left and right channel output signals for application to a speaker system by various mixtures of processed sum and difference signals with the stereophonic left and right input signals. However, in no prior case has there been an attempt to obtain separate reverberant field and direct field signals and to radiate sound based upon such signals in a manner that is optimum for the respective signal types. It has not been previously recognized that direct field sound and reverberant field sound can be separately projected from speaker systems respectively optimized for the particular type of sound, and that the sound types can then be acoustically recombined in space and transmitted to the ear-brain system of the listener.

The sum of the stereophonic left and right signals, namely the sum signal (L+R), itself essentially represents the direct field sound, namely that sound heard by the listener at a performance of a solo vocalist or instrumentalist, positioned in the center of the theater stage. The difference signals, namely (L−R) and (R−L), uniquely represent reverberant field sound which significantly include sound heard by the listener but which is reflected from or reverberating between the theater walls. Direct field sound from a center stage soloist, for example, reaches the listener in a direct line, whereas the reverberant field sound reaches the listener after various reflection in the theater. Thus, according to a feature of the present invention, a speaker system is set up to similarly provide direct field sound to the listener via a direct path and reverberant field sound to the listener via direct or reflective paths, or a combination of both direct and reflective paths.

Referring now to FIG. 1, there is shown a stereo source 10 of left and right stereophonic input signals L and R which may be derived from a radio broadcast receiver, AM, FM or television, or from a stereo playback system whether grooved record, magnetic, optical (laser "compact" disc) or the like. These stereophonic input signals L and R may be derived directly from the playback system or may be processed in some suitable arrangement, as for example, in the stereo enhancement system of my prior application above identified. Thus the signals L and R of FIG. 1 may be derived from the mixer output signals of the enhancement system of such prior co-pending patent application. The signals L and R are fed to respective sum and difference circuits 12, 14, which respectively provide the sum signal (L+R) and the difference signal (L−R), which are the sum and difference of the input signals L and R. These sum and difference signals are fed to a multi-channel power amplifier 16, which also receives the output of an inverter 18 which inverts the (L−R) signal to provide a second difference signal (R−L). Thus the power amplifier provides as its output, amplified versions of the sum signal (L+R), which represents direct field sound of the stereo input, and the two difference signals (L−R) and (R−L), which represent the reverberant field sounds of the stereo input.

A set of speakers is provided to project sound based upon the three outputs of the amplifier 16. The terms speaker, speaker system or loudspeaker, loudspeaker system are used herein to denote systems having one or more electrical to acoustic transducers, each uniquely operable over a selected frequency range. For example, the term speaker may refer to a system having a woofer, tweeter and mid-range transducer or any group or combination thereof. FIG. 1 shows the set as being composed of three speakers, but greater numbers of speakers may be used, as shown in other drawings of the present application, and as described below. A first speaker 20 is energized with the sum signal (L+R) and projects its sound in a relatively narrow dispersion pattern. Speaker 20 is a front radiating speaker having a dispersion pattern of not greater than 60°. The difference signals (L−R) and (R−L) are fed to second and third speakers of the set, namely speakers 22 and 24, which are omnidirectional speakers or speakers having a wide dispersion pattern, which is a pattern of dispersion of at least 120°. Thus each of speakers 22 and 24 may have a dispersion pattern in the range of 120° to 360°, whereas speaker 20 has a dispersion pattern of not more than about 60°.

Speakers with wide dispersion patterns and omnidirectional speakers are known and readily available for use in the present invention. Wide dispersion is relatively easy to achieve below about 800 Hertz, but as wave lengths become shorter in relation to diameter of the radiating area of the speaker transducer, angular dispersion becomes narrower until at frequencies above about 3 Kilohertz, for cone type midrange speakers, and above about 10 Kilohertz for dome type tweeters, the dispersion pattern becomes a narrow beam of sound. It has been found that higher frequencies require maximum angular dispersion to properly reproduce the reverberant field sound based upon difference channel signals. Therefore many speakers do not have a dispersion pattern that is sufficiently wide, over the desired frequency band, to be suitable for projecting reverberant field sound. However, wide dispersion speakers for use in the present invention may be provided by using conventional techniques of wide dispersion horns or arrays of multiple transducers. Although a wide dispersion horn will operate only over a discrete band of frequencies and becomes physically large as cutoff frequency is lower, the horn operates quite satisfactorily at the higher frequencies, and dispersion angle may be made quite large with horns of reasonable dimension.

A dispersive element in the form of an uniquely shaped baffle is disclosed in my co-pending application for Loudspeaker System with Conical Baffle filed July 21, 1987, Ser. No. 076,242. This dispersive element may be used with most forms and sizes of speaker transducers, and is highly efficient, small and inexpensive to manufacture. Angle of dispersion may be designed into the speaker and baffle, and thus a simple conventional cone-type speaker when used with such dispersive element may provide the wide dispersion pattern desirable for the reverberant field speakers, such as speakers 22 and 24 of FIG. 1. Examples of other wide dispersion speakers are shown in U.S. Pat. Nos. 4,580,654 and 4,348,549.

Figure 2:
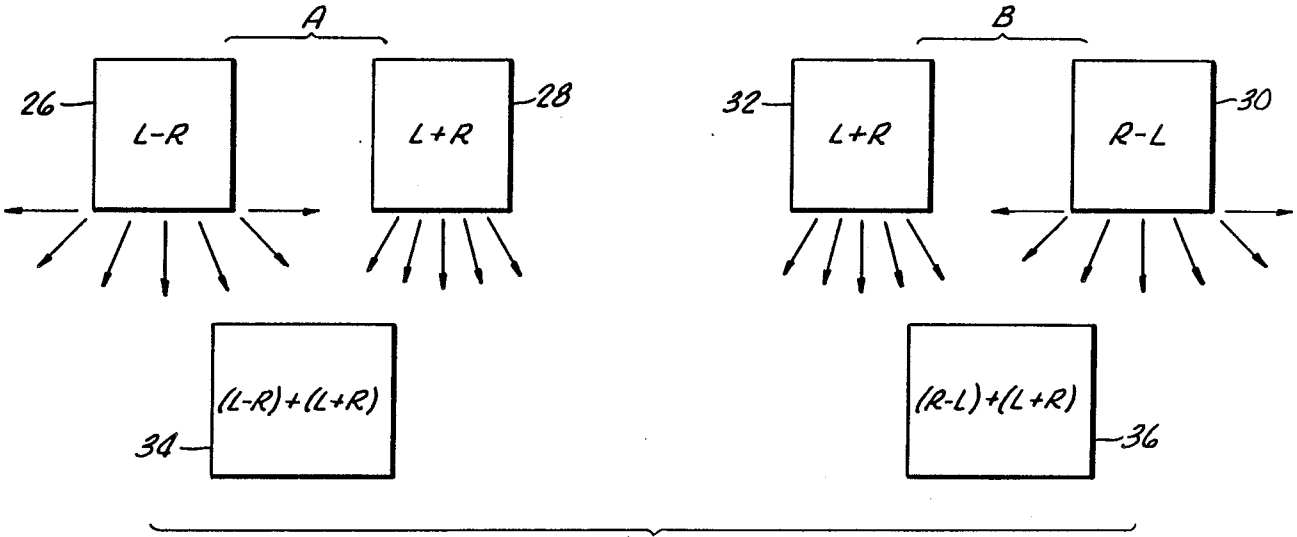
FIG. 2 schematically depicts an arrangement of speakers in accordance with principles of the present invention.

Illustrated in FIG. 2 is an exemplary physical arrangement of a set of four speakers which illustrates operation of the present invention. The speaker set shown in FIG. 2 comprises two pairs of speakers. For example a left pair comprises a wide dispersion pattern speaker 26 and a narrow dispersion front radiating speaker 28. A right pair comprises a similar pair of speakers, including a wide dispersion pattern speaker 30 and a narrow dispersion pattern front radiating speaker 32. Each of the wide dispersion range speakers 26 and 30 is energized with a difference signal, the left difference signal (L−R) being fed to speaker 26, and the right difference signal (R−L) being fed to speaker 30. Each of the front radiating speakers 28 and 32 is fed with the same sum signal (L+R). The arrows pointing away from the various speakers schematically represent the relatively narrow and relatively wide dispersion patterns. Sound projected from the wide and narrow dispersion pattern speakers is directed, at least in part, to a common area for acoustic recombination. Illustrated in FIG. 2, by boxes 34 and 36, is the acoustic recombination of the sounds from the speakers of the respective pairs. Thus, box 34 depicts acoustic recombination of the (L−R) and (L+R) components from speakers 26,28 to provide the left stereophonic signal sound 2L. Similarly box 36 represents the acoustic combination of the right channel direct field and reverberant field sound from speakers 32,30, which respectively radiate sound based on the sum signal (L+R) and the difference signal (R−L), which sounds provide, when combined acoustically, the acoustic equivalent of the right channel signal 2R. The arrangement is such that the listener may be in a wide range of locations without losing advantages of the improved realism of the sound.

Figure 3:
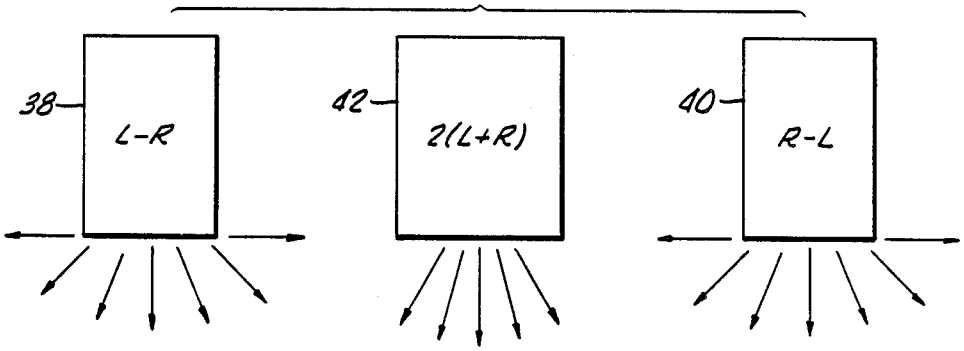
FIG. 3 illustrates a modified speaker arrangement.

FIG. 3 illustrates a modified arrangement of speakers in which wide dispersion pattern speakers 38,40 are positioned on either side of a centrally located narrow dispersion pattern front radiating speaker 42, with speakers 38 and 40 being fed with the difference signals (L−R) and (R−L) respectively, and the center speaker, which is a direct radiating narrow dispersion pattern speaker that cooperates in common with each of the wide dispersion pattern speakers, being fed with the sum signal 2(L+R). Again the direct field and reverberant field sounds of the speakers are acoustically combined by the listener. In one typical arrangement, the three speakers 38, 40 and 42 may be arranged in a line at the center of and along one wall of a room, being spaced at least one foot from the wall to allow for the reflection of the widely dispersed sound from speakers 38 and 40.

Figure 4:
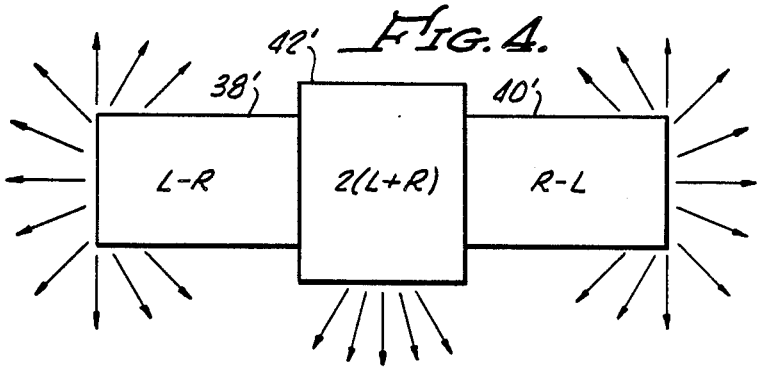
FIG. 4 illustrates a single cabinet incorporating a set of speakers.

FIG. 4 illustrates a slightly modified version of the speaker arrangement of FIG. 3 wherein all three speakers are mounted in a single cabinet with direct front radiating speaker 42' being mounted directly between wide dispersion speakers 38', 40'. The narrow and wide dispersion pattern speakers are energized in the manner described in connection with FIG. 3. In the arrangement of FIG. 4 the center front radiating speaker 42' is provided with a dispersion pattern of not more than about 60°, whereas each of the side speakers 38' and 40' is provided with a wide dispersion pattern in the order of about 270° as illustrated by the pattern of arrows in this figure. The central axes of the radiation pattern of the side speakers 38', 40' are substantially perpendicular to the central axes of the radiation pattern of the center speaker 42'.

Figure 5:
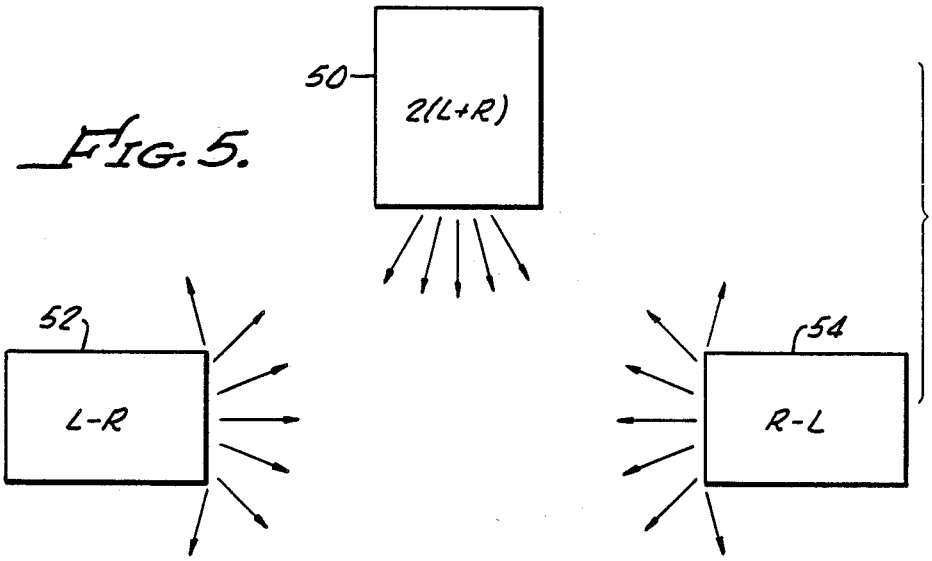
FIGS. 5, 6 and 7 illustrate still further arrangements and organizations of speaker systems.

The speaker arrangements of FIGS. 2, 3 and 4, which are arranged primarily for a living room or the like, may be modified as illustrated in FIG. 5 for use in an automobile. FIG. 5 shows a front radiating narrow dispersion pattern speaker 50 energized by the sum signal 2(L+R) mounted at the center of the dashboard of an automobile and flanked by wide dispersion pattern speakers 52 and 54 respectively energized with difference signals (L−R) and (R−L) and positioned either in opposite doors of the automobile at opposite sides of the driver, or in the respective extreme corners of the automobile dashboard. The direct field speaker 50 has a dispersion pattern of not more than about 60° and the reverberant field speakers 52,54 have wide dispersion patterns of more than 180°.

Figure 6:
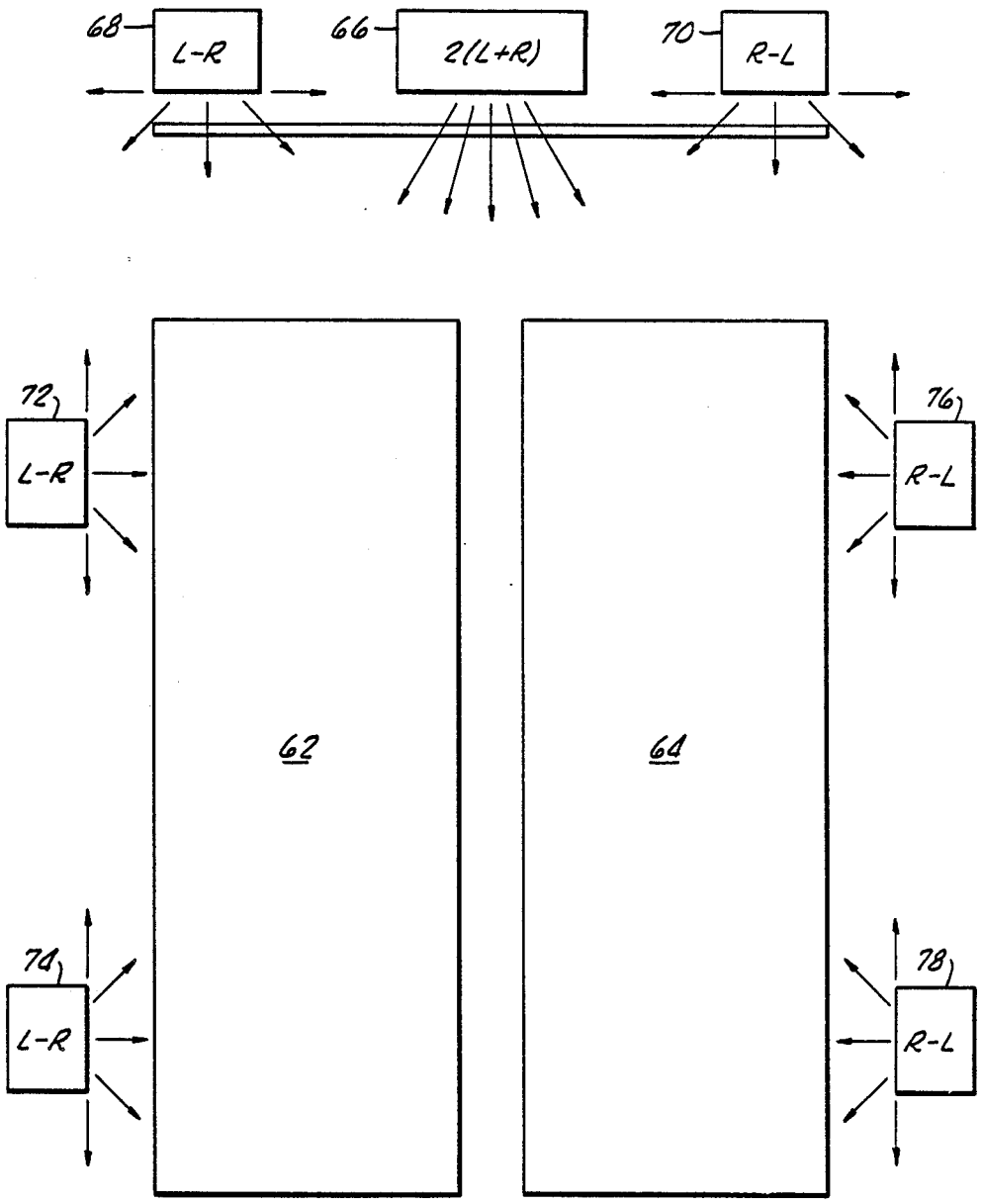

FIG. 6 illustrates a speaker arrangement for a theater wherein a stage at the front of the theater supports a screen 60, for example, and the audience is seated in areas indicated generally at 62, 64. In such an arrangement a narrow dispersion pattern speaker 66, energized by the sum signal 2(L+R) is mounted at the center of the stage, and wide dispersion pattern speakers 68, 70, energized by difference signals (L−R) and (R−L), are mounted on either side of the speaker 66 at opposite sides of the screen 60. Mounted on one side of the theater, such as the left side of the theater, is a pair of additional wide dispersion pattern speakers 72, 74 near the front and near the rear respectively of the left side of the theater, each energized with the difference signal (L−R). On the right side of the theater, at front and back portions respectively, is mounted a second pair of wide dispersion pattern speakers 76, 78, each energized with the difference signal (R−L). The wide dispersion pattern speakers in the arrangement of FIG. 6 may have a dispersion pattern of about 180°, whereas the front radiating direct field narrow dispersion pattern speaker 66 again has a narrow dispersion pattern of not more than about 60°.

Figure 7:
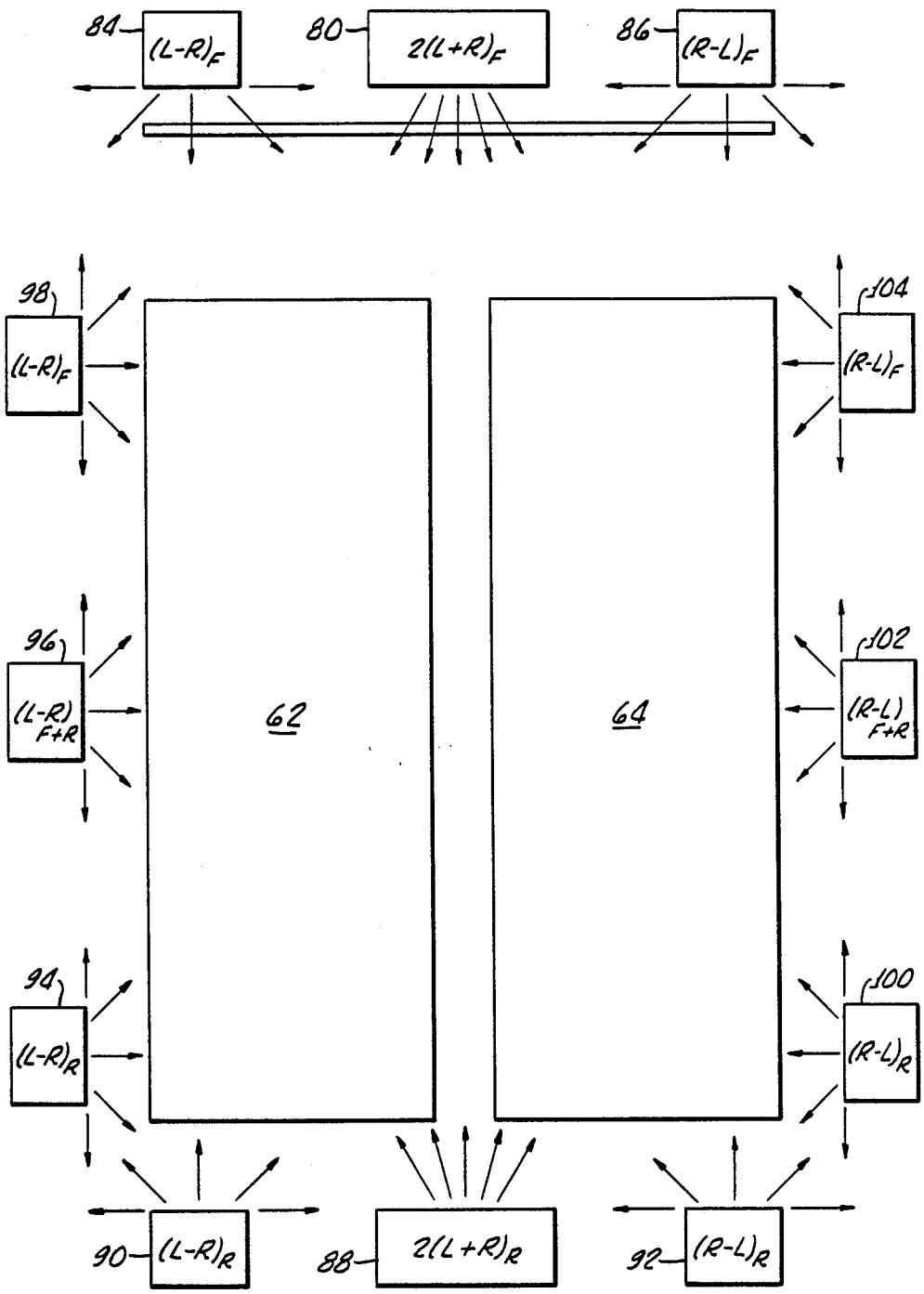

In some theaters separate stereo sound systems are employed for the front and rear so that, in general, a front system energized with front stereophonic left and right signals is provided at the front of the theater, and a rear system energized with rear stereophonic left and right signals is provided at the rear of the theater. Principles of the present invention are applicable to such a total immersion theater sound system, which includes both front and rear sound systems surrounding seating areas 62, 64, in a manner illustrated in FIG. 7. Again a narrow dispersion front radiating speaker 80 is energized by the sum signal $2(L+R)_F$, which is the sum signal of the front stereo system, and is positioned at the center of the front mounted screen 82. At opposite sides of the theater, at the sides of the screen, are mounted wide dispersion pattern speakers 84, 86, energized with the front sound system difference signals $(L-R)_F$ and $(R-L)_F$ respectively.

At the rear of the theater, in the center, is mounted a second narrow dispersion front radiating speaker 88, energized with the sum signal $2(L+R)_R$ of the rear sound system. On either side of speaker 88, at the opposite sides of the rear of the theater, are mounted wide dispersion speakers 90, 92, respectively energized with difference signals $(L-R)_R$ and $(R-L)_R$ of the rear stereo signals. In the exemplary system of FIG. 7 along each side of the theater are mounted three additional wide dispersion pattern speakers 94, 96, and 98 on one side, and wide dispersion pattern speakers 100, 102 and 104 on the other side, the speakers on each side being mounted at front, back and center respectively of the theater sides. Speakers at the front of the theater sides, that is speakers 98 and 104, are energized with the difference signals $(L-R)_F$ and $(R-L)_F$ of the front sound system, whereas speakers at the rear of the sides, speakers 94 and 100, are energized with the difference signals $(L-R)_R$ and $(R-L)_R$ of the rear sound system. Speakers 96 and 102 at the center portions of the theater sides are energized with signals representing a combination of the front sound system difference signals and the rear sound system difference signals. Thus speaker 96 is energized with the difference signal $(L-R)_{F+R}$ and speaker 102 is energized with the difference signal $(R-L)_{F+R}$ where $(L-R)_{F+R}=(L-R)_F+(L-R)_R$ and where $(R-L)_{F+R}=(R-L)_F+(R-L)_R$.

The speakers 88, 90 and 92 at the rear of the theater are all energized with stereophonic left and right signal sum and difference signals of the rear sound system, with center rear speaker 88 being energized with the rear sound system sum signal $2(L+R)_R$ and the side speakers 90,92 at the rear being respectively energized with the difference signals $(L-R)_R$ and $(R-L)_R$ of the rear sound system. In this arrangement of FIG. 7, as in the arrangement of FIG. 6, the narrow dispersion pattern speakers 80,88 have a dispersion pattern of not more than about 60°, whereas each of the other speakers has a wide dispersion pattern of about 180°.

The arrangement of FIG. 5, as described above, is a simplified version of the present system for use in an automobile. In use of this system for an automobile, as distinguished from use of the system in a larger area, such as a music room, living room, theater or the like, position of the speakers with respect to the listener becomes important. Position of the listener with respect to the speakers is important in an automobile because of the very small area of the interior of the automobile, as compared to the area of a normal living room or theater. In such a situation, referring to the arrangement of FIG. 5, for example, the driver of the automobile would be sitting considerably closer to the left side of the car, and thus would be positioned very close to the speaker 52 in the left door and relatively further away from the speaker 54 in the right door. Accordingly, sound from the much closer speaker 52 not only reaches the driver before the corresponding sound from the more remote speaker 54, but is less attenuated because of the considerably shorter distance traveled. In such an arrangement, the driver will hear a sound that is less realistic, since it is a combination of the direct field sound from narrow pattern speaker 50 and reverberant field sound primarily from the wide dispersion speaker 52. Of course a similar situation occurs with the passenger, who hears the reverberant field sound from the right side speaker 54 at a much higher amplitude level than sound from the left side speaker 52.

Figure 8:
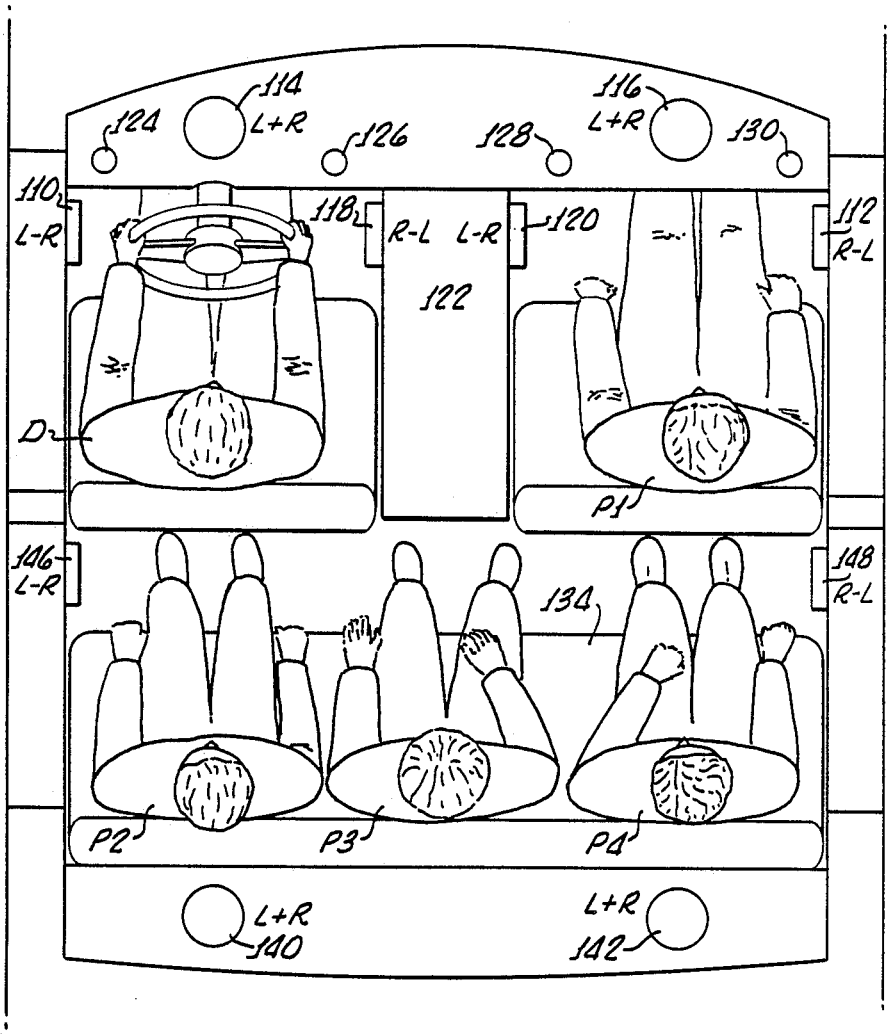
FIG. 8 shows a modification of the speaker arrangement particularly adapted for an automobile.

In order to avoid this limitation in the very close confines of an automobile, principles of the invention may be applied to an automobile speaker arrangement, such as is illustrated in FIG. 8. In this arrangement door mounted speakers 110 and 112 are mounted in the left and right automobile doors, generally at a lowermost portion of the door in order to accommodate the vertically movable door window, and are of the reverberant field type having a wide, preferably 180° or more, dispersion pattern, as previously mentioned in connection with speakers 52 and 54 of FIG. 5. These speakers are fed with the difference signals (L−R) and (R−L) respectively for speakers 110 and 112 (which are modified with direct field signals (L+R) in a manner to be described below). Instead of using a single narrow pattern direct field speaker, as in the arrangement of FIG. 5, a pair of such speakers 114,116 is employed, each mounted at a corner of the automobile dashboard and pointed upwardly to direct sound to be reflected toward the listeners from the windshield. Speakers 114,116 are narrow pattern speakers, having a pattern width of about 60°, as previously mentioned. In this situation a second pair of reverberant field speakers 118,120 is mounted on a center console 122 that projects rearwardly from the dash, with speaker 118 being a wide dispersion pattern speaker of the type previously mentioned, energized with the difference signal (R−L), modified as described below, and pointed directly at and aligned with speaker 110. Similarly, speaker 120 is a wide dispersion pattern speaker energized with the difference signal (L−R) (modified with an (L+R) component as will be described below) and positioned directly opposite and pointed at the speaker 112.

The wide dispersion pattern speakers 110, 112, 118 and 120 are all mounted relatively low, and their high frequency components tend to be absorbed to varying degrees, depending upon the acoustics of the automobile interior and the sound absorption qualities of the automobile upholstery. Particularly for plush upholstery other than vinyl or leather, high frequency sound of these speakers that are mounted at a relatively low position in the automobile tends to be absorbed. Thus the wide dispersion speakers 110, 112, 118 and 120 is each made with a cross-over network and provided with a tweeter to handle the wide dispersion radiation of the higher frequencies, employing a cross-over frequency in the order of about 1,000 Hertz. To this end there are provided wide dispersion reverberant field high frequency tweeters 124,126,128, and 130 respectively coupled with cross-over networks of wide dispersion speakers 110,118,120, and 112 respectively. The tweeters are mounted as indicated on portions of the dash horizontally adjacent the respective low frequency wide dispersion speakers with which they are associated, with tweeters 124 and 130 being positioned at rear corners of the dash pointing upwardly toward the windshield, and tweeters 126,128 being positioned on the top of the dash again, also pointed upwardly at the windshield, but positioned adjacent respective associated low frequency wide dispersion speakers 118, 120. Of course the signals fed to the low frequency wide dispersion speakers 110,118,120 and 112 are also fed to the corresponding tweeters, 124,126,128 and 130, respectively.

In the arrangement illustrated in FIG. 8 and described to this point, the driver, indicated at "D", hears direct field sound from narrow pattern speaker 114, which is energized with a signal (L+R), and a combination of reverberant field sound from speakers 110 and 118, which are energized with the signals (L−R) and (R−L) (as modified by (L+R) as described below). The high frequencies of the reverberant field sound from speakers 124 and 126 are also heard by the driver. Similarly, the passenger on the right side of the car, identified as P1, hears direct field sound from narrow pattern speaker 116, energized by (L+R) and reverberant field sound from speakers 120,112 and tweeters 128,130.

A passenger (not shown) seated in the center of the front seat will hear direct field sound from both speakers 114,116, which produces an apparent source of direct field sound midway between the two. The center passenger also hears the reverberant field sound from speakers 110,112 and tweeters 124,130. Insofar as the center passenger is concerned, sound from the console mounted speakers 118,120, which are mounted very close to one another, and from the tweeters 126 and 128, which are also mounted very close to one another, is effectively cancelled because these speakers effectively radiate sound to the center passenger in the same space. Accordingly, the center passenger hears the image, which is a combination of direct field sound from speakers 114 and 116 and effectively hears only the reverberant field sound from the wide pattern side speakers 110,124 on the left and 112,130 on the right.

Because the sound from the direct field speakers 114,116 is pointed upwardly and reflected from the windshield, and the side door mounted speakers 110,112 are generally required to be mounted at a lower point on the door, there is a relatively large vertical distance between the apparent source of direct field sound and the apparent source of reverberant field sound. Console mounted speakers 118 and 120 are similarly required by the physical constraints of the usual automobile to be mounted at a relatively low portion of the console. When the narrow pattern speakers are energized with sum signal (L+R), and the wide pattern speakers are energized only with the difference signals (L−R) and (R−L), this difference in elevations of direct and reverberant field sound provides an apparent separation of the direct field sound, causing the latter to appear to emanate from a point higher than the reverberant field sound. The direct field sound is that of the soloist, for example, and the reverberant field sound is that of the background orchestra, all as previously described. In order to decrease the effect of this relative difference in elevation which is imposed upon the system by physical constraints of the automobile structural interior, a portion of the direct field sound, the signal (L+R), is fed electrically to the wide dispersion pattern speakers, which also receive the (L−R) and (R−L) components, respectively. In a particular example this portion of (L+R) is approximately fifty percent. However, according to principles of the invention, this portion may vary between twenty-five and seventy-five percent of the direct field sound signal (L+R), depending upon acoustics of the automobile interior and particularly on the nature of the sound absorption qualities of the interior upholstery. Thus, although the speakers 114 and 116 are fed with the direct field signal components L+R, just as previously described, speaker 110 actually receives a combination of (L+R) and (L−R), and, more specifically, the signal $\frac{1}{2}$ (L+R)+(L−R), and the speaker 112 actually receives the signal $\frac{1}{2}$ (L+R)+(R−L). In other words, one-half of the sum signal is electrically added to each difference signal. This addition of a part of the direct field sound component (L+R) to the wide reverberant field speakers provides a greatly improved realism and apparent increase in realistic positioning of both the direct and reverberant field sounds. This addition of the L+R component to the wide dispersion speakers 110,118, 120 and 112 lowers the apparent position of the image of the direct field sound source and decreases dominance of the direct field sound source, which might otherwise tend to occur.

For the rear passengers, identified as P2, P3 and P4, sitting in a back seat 134, narrow pattern direct field sound speakers 140 and 142 are mounted on opposite sides on a shelf behind the rear seat and pointed upwardly toward the car ceiling or sloping rear window. In forward lower portions of the left and right rear doors are mounted wide dispersion reverberant field speakers of broad frequency range, indicated at 146,148, facing toward each other. Direct field sound speakers 140 and 142 add to the sound heard by all passengers in the car, including those in both front and back seats. Generally, as is well known, the rear speakers mounted on the shelf will provide improved low frequency sound because of their ability to use the automobile trunk as a resonant cavity. The wide dispersion pattern reverberant field speakers 118, 120 mounted in the console are sufficiently loud to provide the desired effect for the passengers in the rear seat, who thus get the same effect from the center console mounted speakers. Thus passenger P2 will hear sound from both the front and rear direct field narrow pattern speakers 114, 140 and will hear reverberant field sound (L−R) and (R−L) (as modified by a suitable percentage of (L+R)) from wide dispersion pattern speakers 146, 124, 126 and 118. Similarly passenger P4, on the right side of the rear seat, will hear direct field sound from the narrow pattern speakers 116, 142 and reverberant field sound from speakers 120, 128, 130, 148, which provide the difference signals (L−R) and (R−L) (both modified by an appropriate percentage of (L+R)). The center rear passenger P3 hears sound just as does the center passenger in the front seat, hearing an image from a point between the front direct field sound speaker pair 114, 116 and an image from a point midway between rear mounted direct field speakers 140, 142. The center back seat passenger also hears reverberant field sound from the side mounted rear speakers 146, 148, but hears little sound from the console mounted wide dispersion pattern speakers 118, 120. Wide pattern speakers 146, 148 are also fed with a combination of one-half the sum signal with the difference signals, just as are all the wide pattern speakers.

The described speaker arrangements, in most listening situations where the speakers are mounted in a room or area of reasonably large size, are independent of listener position, so that the significant advantages of the system may be enjoyed by a listener regardless of his position with respect to the speakers. This advantage of flexible listener position is somewhat diminished in the close confinement of the interior of an automobile. For such a close space the speaker arrangement is preferably modified to suit the specifically predetermined listener position, which, of course, is dictated by the automobile seating arrangement.

The speaker systems described herein are tolerant of walls and other reflective surfaces because the front radiating speaker or speakers provide sound directly to the listener, whereas the wide dispersion pattern speakers provide sound that is not adversely affected by reflection from walls of the room, inasmuch as such sound is heard as a reflection or reverberation in the live performance.

Furthermore, as can be seen from the exemplary speaker arrangements illustrated in FIGS. 4, 5, 6, 7 and 8, the speaker choice and arrangement can actually be designed to take advantage of various room sizes, situations and the walls of the room, but is not dependent on such surfaces for its operation, nor is it dependent upon relative location of listener and speakers, except for the confining situation of an automobile where the listener is very close to the speakers, and the described special speaker arrangement is preferred. Accordingly the system is operable outside of any building where no reflective surfaces exist.

As previously mentioned, the described system is compatible with and complementary to the stereo enhancement system described in the above-identified co-pending patent application for Stereo Enhancement System. Desirable effects of the enhancement system of such co-pending application are augmented by the use of the split mode system described herein in the place of ordinary loudspeakers. Although neither the present invention nor that described in the co-pending application requires use of the other, use of the two together considerably enhances operation of both. As previously mentioned, the outputs $L_{IN}$ and $L_{OUT}$ of the enhancement system of my copending application for Stereo Enhancement System may be employed as the inputs L and R of the system illustrated in FIG. 1. Alternatively, the sum, difference and inverting circuits and also the amplifier, if necessary or desirable, of the system of FIG. 1 may be readily incorporated into output portions of the enhancement system of my prior application so that such enhancement system would provide the sum and difference outputs (L+R), (L−R), and (R−L), all based upon signals enhanced as provided in the system of my prior application.

The loudspeaker arrangement illustrated and described herein provides almost complete freedom of listener position. Even in the close confinement of an automobile, all passengers and the driver will benefit from these advantages. This freedom of listener position is of particular importance in application of this system to a theater, where many listeners are seated in various different areas.

What is claimed is:

1. A method of reproducing sound from left and right stereo signals comprising:

combining left and right stereo signals to form a sum signal representing the sum of said stereo signals and difference signals representing the difference between said stereo signals, radiating sound based on said difference signals in wide dispersion patterns over a frequency range, and radiating sound based on said sum signal in a limited dispersion pattern over said frequency range.

2. The method of claim 1 wherein said step of radiating sound based on said difference signals comprises radiating sound from mutually spaced locations.

3. The method of claim 1 wherein said step of radiating sound based on said difference signals comprises radiating sound in patterns having a dispersion of not less than about one hundred twenty degrees, and wherein said step of radiating sound based on said sum signal comprises radiating sound in a pattern having a dispersion of not more than about sixty degrees.

4. The method of claim 1 wherein said step of radiating sound based on said sum signal comprises radiating sound from a first location and wherein said step of radiating a sound based on said difference signals comprises radiating sound from locations at mutually opposite sides of said first location.

5. A method of reproducing sound from left and right stereo signals comprising:

combining left and right stereo signals to form sum and difference signals respectively representing the sum and difference of said stereo signals, and acoustically combining said sum and difference signals to provide left and right acoustic signals, said step of acoustically combining including the steps of:

radiating sound based upon said difference signal in wide dispersion patterns over a selected frequency range, radiating sound based on said sum signal in a narrow dispersion pattern over said frequency range, and directing at least parts of said radiated sound toward a common area.

6. The method of claim 5 wherein said sum signal comprises a signal formed by L+R, where L is said left stereo signal and R is said right stereo signal, and wherein said difference signal comprises a first difference signal (L−R) and a second difference signal (R−L), and wherein said step of acoustically combining said sum and difference signals comprises positioning a speaker having a narrow dispersion pattern at a first location, energizing said first speaker with a signal that is a function of said sum signal, positioning second and third speakers at opposite sides of said first speaker, energizing said second speaker with said difference signal (L−R) and energizing said third speaker with said difference signal (R−L).

7. The method of claim 6 wherein said step of radiating sound based upon said sum signal comprises radiating sound in a pattern having a dispersion of not more than about sixty degrees, and wherein said step of radiating sound based upon said difference signal comprises radiating at least one of said first and second difference signals in a dispersion pattern having a dispersion of not less than about one hundred twenty degrees.

8. A loudspeaker system for providing stereo sound from left and right stereo input signals comprising:

a set of loudspeakers including a first speaker having a narrow dispersion pattern over a frequency range and second and third speakers having wide dispersion patterns over said frequency range, means responsive to said stereo input signals for providing to said first speaker a sum signal representing the sum of said stereo input signals, and for providing to said second and third speakers difference signals representing the difference between said stereo input signals.

9. The system of claim 8 wherein said first speaker has a dispersion width of not more than about sixty degrees, and wherein at least one of said second and third speakers has a dispersion width of not less than about one hundred twenty degrees.

10. The system of claim 8 wherein said first speaker is a front radiating speaker having a dispersion width of not more than about sixty degrees.

11. The system of claim 8 wherein said first speaker is responsive to a sum signal (L+R), where L is said left stereo input signal and R is said right stereo input signal, wherein said second speaker is responsive to a difference signal (L−R), and wherein said third speaker is responsive to a difference signal (R−L).

12. A loudspeaker system for providing stereo sound from left and right stereo input signals comprising:

a set of loudspeakers including a first speaker means having a narrow dispersion pattern over a frequency range and second and third speakers having wide dispersion patterns over said frequency range, means responsive to said stereo input signals for providing to said first speaker a sum signal representing the sum of said stereo input signals, and for providing to said second and third speakers difference signals representing the difference between said stereo input signals, said first speaker means comprising first and second narrow dispersion speakers each responsive to said sum signal, wherein said first narrow dispersion speaker is positioned adjacent said second speaker having a wide dispersion pattern, and wherein said second narrow dispersion speaker is positioned adjacent said third speaker having a wide dispersion pattern.

13. The system of claim 8 including a speaker cabinet, means for mounting said set of loudspeakers in said cabinet, said first speaker being mounted in said cabinet between said second and third speakers, said first speaker having an axis of radiation extending in a first direction, each of said second and third speakers having an axis of radiation extending at a significant angle with respect to said first direction.

14. A loudspeaker system for providing stereo sound from left and right stereo input signals comprising:

a set of loudspeakers including a first speaker having a narrow dispersion pattern over a frequency range and second and third speakers having wide dispersion patterns over said frequency range, means responsive to said stereo input signals for providing to said first speaker a sum signal representing the sum of said stereo input signals, and for providing to said second and third speakers difference signals representing the difference between said stereo input signals, a speaker cabinet, means for mounting said set of loudspeakers in said cabinet, said first speaker being mounted in said cabinet between said second and third speakers, said first speaker having an axis of radiation extending in a first direction, each of said second and third speakers having an axis of radiation extending at a significant angle with respect to said first direction, each of said second and third speakers having a dispersion pattern over said frequency range of greater than 180°, and said first speaker having a dispersion pattern over said frequency range of not more than about 60°.

15. The system of claim 8 wherein said set of loudspeakers is adapted to be mounted in an automobile having a dashboard and first and second sides, said first speaker being adapted to be mounted in a central portion of the dashboard of said automobile, said second and third speakers being adapted to be mounted at said first and second sides respectively.

16. The system of claim 8 wherein said set of loudspeakers is mounted adjacent to but spaced from the wall of a room, and wherein said second and third speakers are positioned on either side of said first speaker.

17. The system of claim 8 wherein said means for providing to said first speaker a sum signal comprises providing a sum signal representing the sum (L+R), wherein L and R respectively represent said left and right stereo input signals, and wherein said means for providing to each of said second and third speakers a difference signal comprises means for providing a first difference signal (L−R) and feeding said first difference signal to said second speaker, and providing a second difference signal (R−L) and feeding said second difference signal to said third speaker.

18. A loudspeaker system for providing stereo sound from left and right stereo input signals comprising:

a set of loudspeakers including a first speaker having a narrow dispersion pattern over a frequency range and second and third speakers having wide dispersion patterns over said frequency range, means responsive to said stereo input signals for providing to said first speaker a sum signal representing the sum of said stereo input signals, and for providing to said second and third speakers difference signals representing the difference between said stereo input signals, said means for providing to said first speaker a sum signal comprising means for providing a sum signal representing the sum (L+R), where L and R respectively represent said left and right stereo input signals, and said means for providing to each of said second and third speakers a difference signal comprising means for providing a first difference signal (L−R) and feeding said first difference signal to said second speaker, and providing a second difference signal (R−L) and feeding said second difference signal to said third speaker, a theater having a front, a back, first and second sides and an audience seating area, said first speaker being responsive to a signal proportional to the sum signal (L+R) and being positioned at a central portion of the front of said theater, said second speaker being responsive to said first difference signal (L−R) and being positioned on one side of said first speaker at the front of said theater, said third speaker being responsive to said difference signal (R−L) and being positioned on the other side of said first speaker at the front of said theater.

19. The system of claim 18 including a fourth speaker having a wide dispersion pattern positioned at one side of said theater rearwardly of the front of the theater and being responsive to said difference signal (L−R), and a fifth speaker having a wide dispersion pattern positioned at the other side of said theater and being responsive to said difference signal (R−L).

20. The system of claim 19 wherein said first mentioned stereo input signals are front stereo input signals $L_F$ and $R_F$ provided from a front sound system, and including a rear sound system providing rear left and rear right stereo input signals $L_R$ and $R_R$, said first, second, third, fourth and fifth speakers being responsive to signals from said front sound system, said set of speakers including a first rear speaker having a narrow dispersion pattern and second and third rear speakers having wide dispersion patterns, said first rear speaker being responsive to a signal proportional to a sum signal $(L+R)_R$ representing the sum of the rear left and rear right stereo input signals, said second rear speaker being responsive to a difference signal $(L-R)_R$ representing a difference between the rear left and rear right stereo input signals, said third rear speaker being responsive to a difference signal $(R-L)_R$ representing the difference between the rear left and rear right stereo input signals, said first rear speaker being positioned at the center of the rear of said theater, and said second and third rear speakers being positioned at the rear of said theater on either side of said first rear speaker.

21. The system of claim 20 including first and second combined front and rear speakers each having a wide dispersion pattern and positioned respectively on opposite sides of said theater, said first combined front and rear speaker beig responsive to a combined difference signal $(L-R)_{F+R}$ representing the sum of a difference signal of said front sound system and a difference signal of said rear sound system, and said second combined side speaker being responsive to a combined difference signal $(R-L)_{F+R}$ representing the sum of a difference signal of said front sound system and a difference signal of said rear sound system.

22. A method of reproducing stereo sound from electrical stereo signals that include components representing direct field sounds and reverberant field sounds comprising:

employing said stereo signals to reproduce direct field sounds projected from a front radiating speaker system, and employing said stereo signals to reproduce reverberant field sounds projected from a speaker system having a wider pattern of dispersion than said front radiating speaker system.

23. The method of claim 22 wherein said electrical stereo signals comprise left and right stereophonic signals and including the step of providing sum and difference signals representing the sum and difference of said stereophonic signals, said step of employing said stereo signals to reproduce direct field sounds comprising the step of feeding said sum signal to a front radiating speaker system having a limited angle of dispersion, and wherein said step of employing said stereo signal to reproduce reverberant field sounds comprises feeding said difference signal to a speaker system having a wide pattern of dispersion.

24. The method of claim 22 including positioning said front radiating speaker system at a central location and positioning first and second speaker systems each having a wide pattern of dispersion on opposite sides of said central location and energizing said first and second wide dispersion speaker systems with mutually opposite phase versions of said difference signal.

25. The method of claim 24 including positioning said speakers adjacent one wall of a room.

26. The method of claim 22 including the step of radiating direct field sounds from said front radiating speaker system in a dispersion pattern having a width of not more than about sixty degrees and projecting said reverberant field sounds from a speaker system having a wide dispersion pattern of a width not less than about one hundred twenty degrees.

27. A method of reproducing sound from left and right stereo signals comprising:

combining left and right stereo signals to form sum and difference signals respectively representing the sum and difference of said stereo signals, providing first and second mutually spaced pairs of speakers, each pair comprising a speaker having a limited dispersion over a frequency range and a speaker having a wide dispersion over said frequency range, energizing said limited dispersion speakers with said sum signal, and energizing said wide dispersion speakers with said difference signal.

28. The method of claim 27 wherein one of said limited dispersion speakers is common to both pairs.

29. A method of reproducing sound from left and right stereo signals comprising:

combining left and right stereo signals to form sum and difference signals respectively representing the sum and difference of said stereo signals, acoustically combining said sum and difference signals to provide left and right acoustic signals, said step of acoustically combining including the steps of:

radiating sound based upon said difference signal in wide dispersion patterns over a selected frequency range from mutually spaced locations, radiating sound based on said sum signal in a narrow dispersion pattern over said frequency range, directing at least parts of said radiated sound toward a common area, wherein said sum signal comprises a signal formed by L+R, where L is said left stereo signal and R is said right stereo signal, and wherein said difference signal comprises a first difference signal (L−R) and a second difference signal (R−L), and wherein said step of acoustically combining said sum and difference signals comprises positioning a speaker having a narrow dispersion pattern over said frequency range at a first location, energizing said first speaker with a signal that is a function of said sum signal, positioning second and third speakers at opposite sides of said first speaker, energizing said second speaker with said difference signal (L−R) and energizing said third speaker with said difference signal (R−L), including the step of adding a portion of said sum signal to said first and second difference signals.

30. The system of claim 10 wherein said first speaker is responsive to a sum signal (L+R), where L is said left stereo input signal and R is said right stereo input signal, wherein said second speaker is responsive to a difference signal (L−R) plus a portion of said sum signal (L+R), and wherein said third speaker is responsive to a difference signal (R−L) plus a portion of said sum signal (L+R).

31. The system of claim 8 wherein said set of loudspeakers is adapted to be mounted in an automobile having a dashboard, first and second sides, and a driver seat between said first and second sides, and wherein said first speaker is adapted to be mounted adjacent one end of the dashboard, wherein said second speaker is adapted to be mounted at said first side at a first distance from the driver seat, and wherein said third speaker is adapted to be mounted at a distance from said driver seat substantially equal to said first distance.

32. A loudspeaker system for providing stereo sound from left and right stereo input signals comprising:

a set of loudspeakers including a first speaker having a narrow dispersion pattern over a frequency range and second and third speakers having wide dispersion patterns over said frequency range, means responsive to said stereo input signals for providing to said first speaker a sum signal representing the sum of said stereo input signals, and for providing to said second and third speakers difference signals representing the difference between said stereo input signals, wherein said set of loudspeakers is adapted to be mounted in an automobile having a dashboard, first and second sides, and a driver seat between said first and second sides, and wherein said first speaker is adapted to be mounted adjacent one end of the dashboard, wherein said second speaker is adapted to be mounted at said first side at a first distance from the driver seat, and wherein said third speaker is adapted to be mounted at a distance from said driver seat substantially equal to said first distance, including a second set of loudspeakers comprising a fourth speaker having a narrow dispersion pattern over said frequency range and fifth and sixth speakers having wide dispersion patterns over said frequency range, said fourth speaker being adapted to be mounted on said dashboard adjacent a passenger seat position, said automobile having a passenger seat position, said fifth speaker being adapted to be mounted at said second side of the automobile at a second distance from said passenger seat position, and wherein said sixth speaker is adapted to be mounted between said first and second sides at a distance from said passenger position substantially equal to said second distance.

33. The system of claim 32 wherein each of said second, third, fifth and sixth speakers includes a tweeter, each of said tweeters being adapted to be mounted on said dashboard.

34. The system of claim 31 wherein said means for providing to said first speaker a sum signal comprises means for providing a sum signal representing the sum (L+R), where L and R respectively represent said left and right stereo input signals, and wherein said means for providing to each of said second and third speakers a difference signal comprises means for providing a first combination signal including (L−R) and a portion of said sum signal (L+R) and feeding said first combination signal to said second speaker, and wherein said means for providing a difference signal to said third speaker comprises means for providing a second combination signal comprising a second difference signal (R−L) plus a portion of said sum signal (L+R) and feeding said second combination signal to said third speaker.

35. The system of claim 33 wherein said automobile includes a rear passenger seat and a rear shelf behind the rear passenger seat, and including a seventh speaker having a narrow dispersion pattern mounted at one side of said rear shelf and an eighth speaker having a narrow dispersion pattern mounted on a second side of said rear shelf, a ninth speaker having a wide dispersion pattern mounted at said first side adjacent said rear passenger seat and a tenth speaker having a wide dispersion pattern mounted at said second side adjacent said rear passenger seat, and means responsive to said stereo input signals for providing said sum signal to said seventh and eighth speakers and for providing difference signals to said ninth and tenth speakers.

36. In combination with an automotive vehicle having first and second sides, a dashboard and a seat having passenger and driver seat positions, an improved loudspeaker system for providing stereo sound from left and right stereo input signals, said loudspeaker system comprising:

a first speaker having a narrow dispersion pattern over a frequency range mounted on said dashboard adjacent said driver seat position, second and third speakers each having wide dispersion patterns over said frequency range, said second speaker being mounted at a first distance from said driver seat position and said third speaker being mounted between said first and second sides at a distance from said driver seat position substantially equal to said first distance, and means responsive to said stereo input signals for providing to said first speaker a sum signal representing the sum of said stereo input signals and for providing to said second and third speakers difference signals representing the difference between said stereo input signals.

37. The combination of claim 36 including a fourth speaker having a narrow dispersion pattern over said frequency range mounted on said dashboard at a position adjacent said passenger seat position, a fifth speaker having a wide dispersion pattern over said frequency range mounted at said second side at a second distance from said passenger seat position, and a sixth speaker mounted between said first and second sides at a distance from said passenger seat position equal to said second distance, means responsive to said stereo input signals for providing said sum signal to said fourth speaker and for providing to said fifth and sixth speakers difference signals representing the difference between said stereo input signals.

38. The system of claim 37 including means for mixing a portion of said sum signal with said difference signal before providing said difference signals to said second, third, fifth and sixth speakers.

39. The system of claim 37 wherein said automobile includes a rear passenger seat and a rear shelf, and further including seventh and eighth speakers having narrow dispersion patterns over said frequency range mounted respectively at opposite ends of said rear shelf, and ninth and tenth speakers having wide dispersion patterns over said frequency range mounted respectively at said first and second sides of said automobile adjacent opposite ends of said rear passenger seat, means for providing said sum signal to said seventh and eighth speakers and means for providing said difference signals to said ninth and tenth speakers.

40. The combination of claim 39 wherein said second and third and fifth and sixth speakers each includes an individual tweeter, said tweeters being mounted on said automobile dashboard respectively adjacent individual ones of said second, third, fifth and sixth wide dispersion pattern speakers.

* * * * *